US008945274B2

(12) United States Patent
Sato et al.

(10) Patent No.: US 8,945,274 B2
(45) Date of Patent: Feb. 3, 2015

(54) METHOD FOR OPERATING BLAST FURNACE

(75) Inventors: Takeshi Sato, Chiba (JP); Taihei Nouchi, Kanagawa (JP); Hidekazu Fujimoto, Kanagawa (JP); Takashi Anyashiki, Kanagawa (JP); Hideaki Sato, Kanagawa (JP)

(73) Assignee: JFE Steel Corporation (JP)

( * ) Notice: Subject to any disclaimer, the term of this patent is extended or adjusted under 35 U.S.C. 154(b) by 387 days.

(21) Appl. No.: 13/388,786

(22) PCT Filed: Aug. 10, 2010

(86) PCT No.: PCT/JP2010/063797

§ 371 (c)(1),
(2), (4) Date: May 1, 2012

(87) PCT Pub. No.: WO2011/019086

PCT Pub. Date: Feb. 17, 2011

(65) Prior Publication Data

US 2012/0205839 A1 Aug. 16, 2012

(30) Foreign Application Priority Data

Aug. 10, 2009 (JP) ..... 2009-185412
Aug. 4, 2010 (JP) ..... 2010-175265

(51) Int. Cl.
*C21B 15/00* (2006.01)
*C21B 5/00* (2006.01)

(52) U.S. Cl.
CPC ..... *C21B 5/008* (2013.01); *C21B 5/007* (2013.01)
USPC ..... 75/460; 75/458

(58) Field of Classification Search
CPC ..... C21B 5/007; C21B 5/008
USPC ..... 266/44; 75/458, 460
See application file for complete search history.

(56) References Cited

U.S. PATENT DOCUMENTS

2012/0205839 A1 * 8/2012 Sato et al. ..... 266/44

FOREIGN PATENT DOCUMENTS

| | | | |
|---|---|---|---|
| JP | 63-210207 A | | 8/1988 |
| JP | 2006-028594 A | | 2/2006 |
| JP | 2008-106320 A | | 5/2008 |
| JP | 2008189952 A | * | 8/2008 |

OTHER PUBLICATIONS

Machine translation of JP 2008-189952A, Aug. 2008.*
Machine Translation of JP 2008-106320, Aug. 2008.*
Machine Translation of JP 2006-028594, Feb. 2006.*
(Continued)

*Primary Examiner* — Scott Kastler
(74) *Attorney, Agent, or Firm* — DLA Piper LLP (US)

(57) ABSTRACT

A coke layer and an ore layer are formed in a blast furnace. The coke layer is formed of conventional coke and the ore layer is formed of carbon iron composite, conventional coke, and ore. The mixing percentage of the conventional coke in the ore layer with respect to the ore is 0.5 mass % or more. Slowing of the gasification reaction of carbon iron composite in the cohesive zone can be suppressed.

14 Claims, 4 Drawing Sheets

(56) References Cited

OTHER PUBLICATIONS

Sasaki, M. et al., "Formation and Melt-Down of Softening-Melting Zone in Blast Furnace (Report on the Dissection of Blast Furnaces—3)," *The Iron and Steel Institute of Japan*, Tetsu-to-Hagane 62, 1976, pp. 559-569, Synopsis in English.

"Gas Permeability and Porosity of a Cohesive Zone Extracted fro Inside of a Blast Furnace," *The Iron and Steel Institute of Japan*, Tetsu-to-Hagane 64, 1978, p. 94 and 2 pages of partial English translation.

Watakabe, S. et al., "Development of High Ratio Coke Mixed Charging Technique to the Blast Furnace," *The Iron and Steel Institute of Japan*, Tetsu-to-Hagane 92, 2006, vol. 92, No. 12, pp. 209-218, Synopsis in English.

* cited by examiner

PRIOR ART

METHOD FOR OPERATING BLAST FURNACE

RELATED APPLICATIONS

This is a §371 of International Application No. PCT/JP2010/063797, with an international filing date of Aug. 10, 2010 (WO 2011/019086 A1, published Feb. 17, 2011), which is based on Japanese Patent Application Nos. 2009-185412, filed Aug. 10, 2009, and 2010-175265, filed Aug. 4, 2010, the subject matter of which is incorporated by reference.

TECHNICAL FIELD

This disclosure relates to a method for operating a blast furnace using carbon iron composite (ferrocoke) produced by forming and carbonizing a mixture of coal and iron ore.

BACKGROUND

To decrease the reducing agent ratio of a blast furnace, there is an advantageous technique of using carbon iron composite as a material for the blast furnace to utilize the effect of decreasing the temperature of the thermal reserve zone of the blast furnace due to the use of carbon iron composite (for example, refer to Japanese Unexamined Patent Application Publication No. 2006-28594. Carbon iron composite produced by forming a mixture of coal and iron ore into a formed product and carbonizing the formed product has high reactivity and, hence, promotes reduction of sintered ore. Carbon iron composite also partially contains reduced iron ore and, hence, the temperature of the thermal reserve zone of a blast furnace can be decreased and the reducing agent ratio can be decreased.

A method for operating a blast furnace with carbon iron composite may be performed by mixing ore and carbon iron composite and charging the mixture into the blast furnace as disclosed in JP '594.

Carbon iron composite is characterized by having higher reactivity with $CO_2$ gas as represented by a formula (a) below than conventional metallurgical coke produced by carbonizing coal with a coke oven or the like (hereafter, described as "conventional coke" to distinguish it from carbon iron composite). The reaction in the formula (a) below can be regarded as a reaction of returning $CO_2$ generated through reduction of ore represented by a formula (b) below back to CO gas having reducing power:

$$CO_2+C \rightarrow 2CO \quad (a)$$

$$FeO+CO \rightarrow Fe+CO_2 \quad (b).$$

Accordingly, when the reaction of the formula (a) above rapidly occurs in a region where the reaction of the formula (b) above occurs, both of the reactions successively occur to promote reduction of ore.

A region of a blast furnace where $CO_2$ generated from the formula (b) above corresponds to a region where ore is not completely reduced by CO gas, that is, unreduced ore is present.

It is known that ore mainly containing sintered ore in an upper zone of a blast furnace is in the form of independent particles. As reduction proceeds, ore particles having softened and deformed cohere together to form the so-called cohesive zone (for example, refer to The Iron and Steel Institute of Japan, "Tetsu-to-Hagane," 62, 1976, pages 559-569). Since ore particles having softened and deformed cohere together to form the cohesive zone, the cohesive zone has a small number of voids and has high gas-permeation resistance (for example, refer to The Iron and Steel Institute of Japan, "Tetsu-to-Hagane," 64, 1978, page S548). This means that reducing gas is less likely to enter the cohesive zone. According to The Iron and Steel Institute of Japan, 62, 1976, reducibility of sintered ore in the cohesive zone is about 65% to 70% and reduction is not completed. Ore not completely reduced in the cohesive zone is, in the state of having a high FeO concentration, melted and dripped, resulting in reduction with solid carbon as represented by the following formula (c):

$$FeO+C \rightarrow Fe+CO \quad (c).$$

This reaction is an endothermic reaction. Thus, a decrease in the reaction rate of the formula (c) above contributes to a decrease in the reducing agent ratio and suppresses variation in furnace heat in a lower zone of a blast furnace, contributing to stable operation.

When carbon iron composite is used in operation of a blast furnace and carbon iron composite is used as a mixture with ore, carbon iron composite is present in the cohesive zone in a temperature range in which the cohesive zone is formed. When reduction of ore is not completed in the cohesive zone as described above, the gasification reaction of carbon iron composite in the cohesive zone becomes slow, which is problematic.

To exhibit the high-reactivity characteristic of carbon iron composite, that is, to achieve rapid transition from $CO_2$ gas to CO gas in the cohesive zone, it is necessary that CO gas is introduced into the cohesive zone so that reduction of unreduced ore proceeds to generate $CO_2$.

Accordingly, it could be helpful to overcome the problem of the existing techniques and provide a method for operating a blast furnace with carbon iron composite in which carbon iron composite is used as a mixture with ore in a blast furnace and slowing of the gasification reaction of carbon iron composite in the cohesive zone can be suppressed.

SUMMARY

We thus provide:

(1) A method for operating a blast furnace with carbon iron composite (ferrocoke), including forming a coke layer and an ore layer in a blast furnace,
wherein the coke layer is formed of conventional coke, and
the ore layer is formed of carbon iron composite, conventional coke, and ore.

(2) The method for operating a blast furnace with carbon iron composite according to (1), wherein a mixing percentage of the conventional coke in the ore layer with respect to the ore is 0.5 mass % or more.

(3) The method for operating a blast furnace with carbon iron composite according to (2), wherein the mixing percentage of the conventional coke in the ore layer with respect to the ore is 0.5 to 6 mass %.

(4) The method for operating a blast furnace with carbon iron composite according to (3), wherein the mixing percentage of the conventional coke in the ore layer with respect to the ore is 2 to 5 mass %.

(5) The method for operating a blast furnace with carbon iron composite according to any one of (1) to (4), wherein a mixing percentage of the carbon iron composite in the ore layer with respect to the ore is 1 mass % or more.

(6) The method for operating a blast furnace with carbon iron composite according to any one of (1) to (5), wherein a total mixing percentage of the conventional coke and the carbon iron composite in the ore layer with respect to the ore is 1.5 to 20 mass %.

(7) The method for operating a blast furnace with carbon iron composite according to (6), wherein the total mixing percentage of the conventional coke and the carbon iron composite in the ore layer with respect to the ore is 1.5 to 15 mass %.

(8) The method for operating a blast furnace with carbon iron composite according to any one of (1) to (7), wherein the carbon iron composite has an iron content of 5 to 40 mass %.

(9) The method for operating a blast furnace with carbon iron composite according to (8), wherein the carbon iron composite has an iron content of 10 to 40 mass %.

(10) The method for operating a blast furnace with carbon iron composite according to any one of (1) to (9), wherein the conventional coke in the ore layer has a particle size of 5 to 100 mm.

(11) The method for operating a blast furnace with carbon iron composite according to (10), wherein the conventional coke in the ore layer has a particle size of more than 20 mm and 100 mm or less.

(12) The method for operating a blast furnace with carbon iron composite according to (11), wherein the conventional coke in the ore layer has a particle size of more than 36 mm and 100 mm or less.

(13) The method for operating a blast furnace with carbon iron composite according to any one of (1) to (12), wherein the ore layer and the coke layer are alternately formed.

(14) The method for operating a blast furnace with carbon iron composite according to any one of (1) to (13), wherein the ore layer is composed of a mixture of the carbon iron composite, the conventional coke, and the ore.

(15) The method for operating a blast furnace with carbon iron composite according to any one of (1) to (14), wherein the ore layer is formed by charging a mixture of the carbon iron composite, the conventional coke, and the ore into the blast furnace, the mixture having been prepared in advance.

(16) The method for operating a blast furnace with carbon iron composite according to any one of (1) to (15), wherein the ore layer is formed by charging the carbon iron composite, the conventional coke, and the ore into the blast furnace while the carbon iron composite, the conventional coke, and the ore are mixed together.

(17) The method for operating a blast furnace with carbon iron composite according to any one of (1) to (16), wherein the ore layer comprises a first ore layer and a second ore layer that are charged in two batches; and, in both of the first and second ore layers, the carbon iron composite, the conventional coke, and the ore are mixed together.

In the cohesive zone, mixing conventional coke ensures the presence of voids in the ore layer to improve permeability, facilitating entry of CO gas into the cohesive zone. As a result, reduction of ore is promoted through the gasification reaction of carbon iron composite to thereby decrease the reducing agent ratio.

EXPLANATION OF REFERENCE NUMERALS

Figure 1:
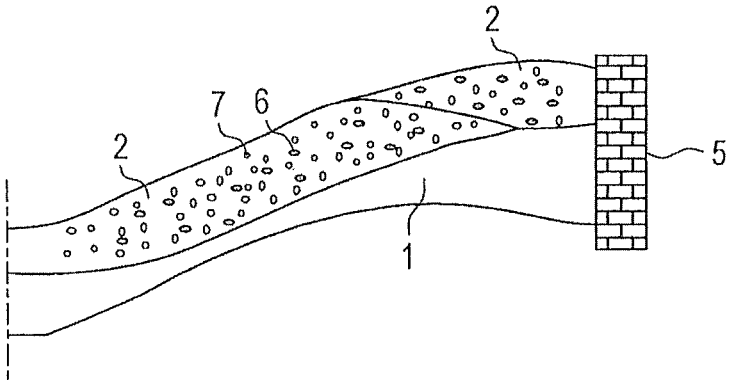
FIG. 1 is a schematic view of a longitudinal section of a blast furnace (our Example).

1 coke layer composed of conventional coke
2 ore layer composed of carbon iron composite, conventional coke, and ore
3 ore layer composed of conventional coke and ore
4 ore layer composed of carbon iron composite and ore
5 furnace wall of blast furnace
6 carbon iron composite
7 conventional coke

DETAILED DESCRIPTION

In a conventional operation of a blast furnace, ore and conventional coke are alternately charged into the blast furnace through a top portion of the furnace to alternately pile an ore layer and a conventional coke layer in the blast furnace. For the purpose of improving the operation of a blast furnace, there is a known technique of using a mixture of conventional coke and ore (for example, refer to The Iron and Steel Institute of Japan, "Tetsu-to-Hagane," 92, 2006, pages 901-910). The Iron and Steel Institute of Japan, 92, 2006 describes the effect of improving the permeability of the cohesive zone due to mixing of conventional coke with an ore layer on the basis of a reduction test under load with which the cohesive behavior of ore can be evaluated. Note that, in our process, ore collectively denotes one or more iron-containing materials (mixture) charged into a blast furnace such as sintered ore produced from iron ore, lump iron ore, and pellets. Ore layers stacked in a blast furnace may contain, in addition to ore, an auxiliary material for adjusting the composition of slag, such as limestone.

Figure 4:
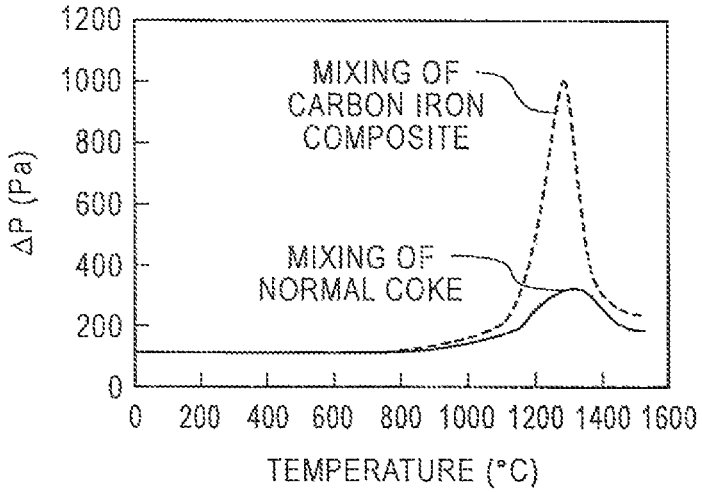
FIG. 4 is a graph illustrating the results of a reduction test under load.

We studied permeability in the case of mixing carbon iron composite and sintered ore with a reduction test under load apparatus of the same type as in The Iron and Steel Institute of Japan, 92, 2006 and compared this case with the case of mixing conventional coke and sintered ore. The test results are illustrated in FIG. 4. Sintered ore was mixed with 5 mass % of coke (as for carbon iron composite, the coke content of 70 mass % was considered). The test results show that, when sintered ore is in a cohesive state, pressure loss ($\Delta P$) of gas increases; the pressure loss is lower and greater effect of improving the permeability of the cohesive zone is provided in the case of mixing conventional coke than in the case of mixing carbon iron composite. Accordingly, to improve permeability of the cohesive zone, mixing conventional coke with ore is more effective than mixing carbon iron composite with ore.

We found that mixing conventional coke, together with carbon iron composite, with ore promotes introduction of CO gas into the cohesive zone and the above-described successive reactions of reduction of unreduced ore and gasification of carbon iron composite are promoted to enhance reducibility of the ore.

Specifically, we provide a method for operating a blast furnace including charging carbon iron composite and conventional coke that are in a state of being mixed in the same ore layer, into a blast furnace. The state in which carbon iron composite and conventional coke are mixed in the same ore layer is a state in which carbon iron composite and conventional coke are dispersed in the entirety of the ore layer. This state excludes the following case: an ore layer is formed in a plurality of charging batches where carbon iron composite only is mixed with ore in some charging batches and conventional coke only is mixed with ore in other charging batches.

To charge carbon iron composite and conventional coke that are in a state of being mixed in the same ore layer into a blast furnace, for example, the following method may be used: a method of charging carbon iron composite, conventional coke, and ore having been mixed together in advance, into the furnace with a charging apparatus at the top of the furnace; or a method of charging carbon iron composite, conventional coke, and ore into the furnace while carbon iron composite, conventional coke, and ore are mixed together.

When materials are charged into a blast furnace, a coke layer composed of conventional coke and an ore layer mixed with carbon iron composite and conventional coke are preferably alternately stacked.

Figure 5:
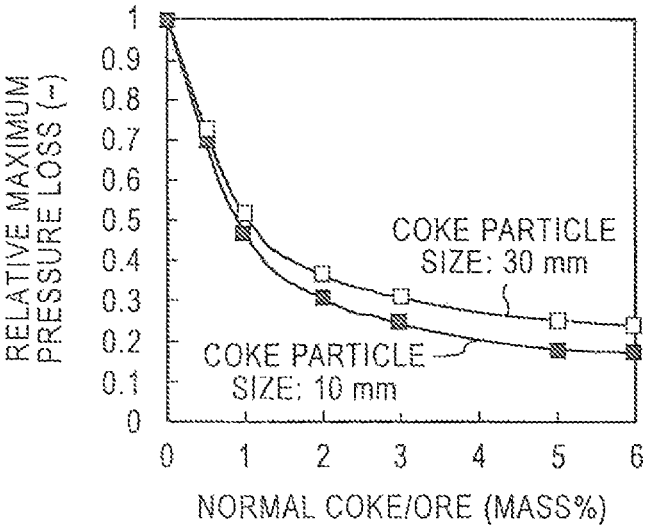
FIG. 5 is a graph illustrating the results of a reduction test under load.

The percentage of conventional coke mixed with an ore layer is preferably 0.5 mass % or more with respect to the ore. FIG. 5 illustrates the relationship between the maximum pressure loss value (relative value) and the amount of conventional coke mixed with an ore layer in the reduction test under load. From FIG. 5, although the maximum pressure loss decreases with an increase in the mixing amount of conventional coke, even a mixing amount of 0.5 mass % results in about 30% decrease in the pressure loss with respect to the case (base) where conventional coke is not mixed. Accordingly, mixing 0.5 mass % or more of conventional coke sufficiently provides the effect of decreasing the pressure loss. When the mixing amount of conventional coke is 5 mass % or more, the effect of decreasing the pressure loss is saturated. Accordingly, the mixing amount of conventional coke is preferably 6 mass % or less, more preferably 5 mass % or less. It is shown that such tendencies are consistent regardless of the particle size of coke.

Figure 6:
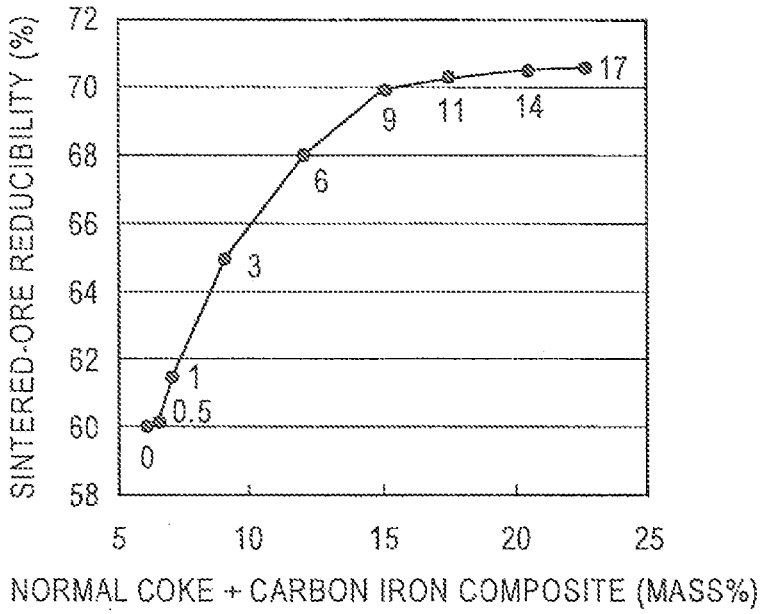
FIG. 6 is a graph illustrating the relationship between the amount of conventional coke and carbon iron composite mixed in an ore layer and the reducibility of sintered ore.

On the other hand, carbon iron composite may be mixed with ore under conditions similar to the above-described condition of mixing conventional coke. However, when the mixing amount of carbon iron composite is small, the number of positions where the effect of returning $CO_2$ in an ore layer back to CO is exhibited through the reaction in the formula (a) above is limited. When the total amount of conventional coke and carbon iron composite mixed with ore is large, in an actual furnace, there may be cases where the cokes mixed in an ore layer after charging into the furnace are unevenly distributed and the reproduction effect of CO gas is not sufficiently exhibited. Specifically, the probability that conventional coke and carbon iron composite are present next to each other becomes high and carbon iron composite becomes separated from positions where $CO_2$ is generated by reduction of ore. FIG. 6 illustrates results of mixing conventional coke and carbon iron composite with 500 g of sintered ore serving as ore and causing the cokes and the ore to react at 900° C. in an atmosphere of $CO:N_2=0.3:0.7$ (mass ratio) for 3 hours. The mixing amount of conventional coke was 6 mass %. In FIG. 6, the numbers attached to the points in the graph represent the mixing amount (mass %) of carbon iron composite only. From FIG. 6, 1.0 mass % or more of carbon iron composite mixed with ore provides the effect of increasing the reducibility of sintered ore. When the total amount of conventional coke and carbon iron composite with respect to ore is about 15 mass %, the increase rate of the reducibility starts to decrease. When the total amount is about 20 mass %, the increasing effect is saturated. Accordingly, the total amount of conventional coke and carbon iron composite with respect to ore is preferably 20 mass % or less, more preferably 15 mass % or less.

Figure 7:
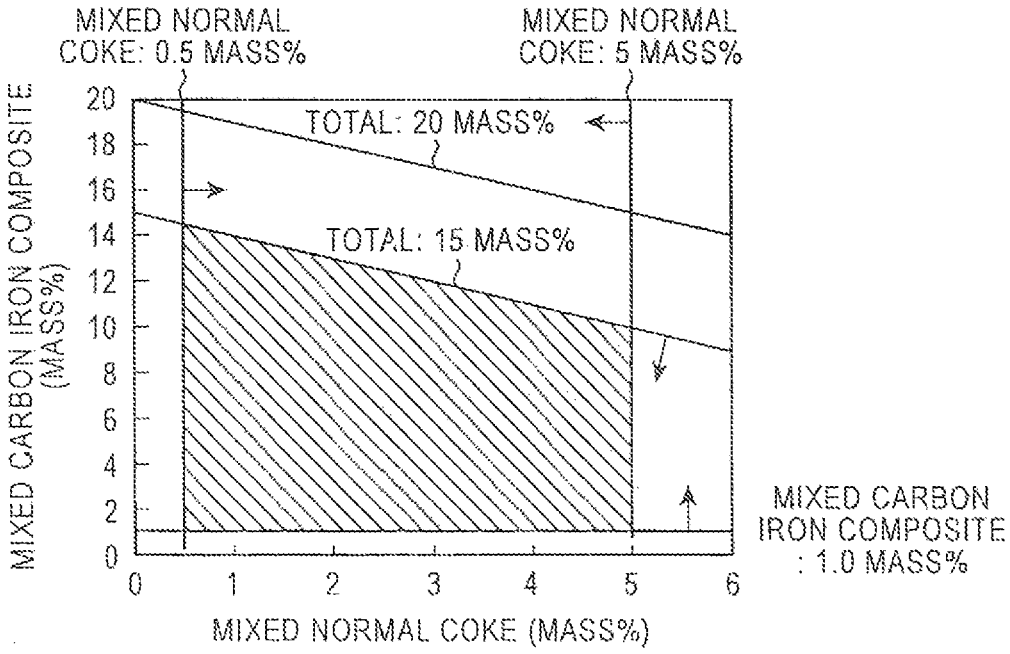
FIG. 7 is a graph illustrating the range of conventional coke and carbon iron composite mixed in an ore layer.

The above-described mixing conditions are summarized in FIG. 7. In FIG. 7, the hatched area represents a particularly preferred mixing range of conventional coke and carbon iron composite in an ore layer.

Figure 8:
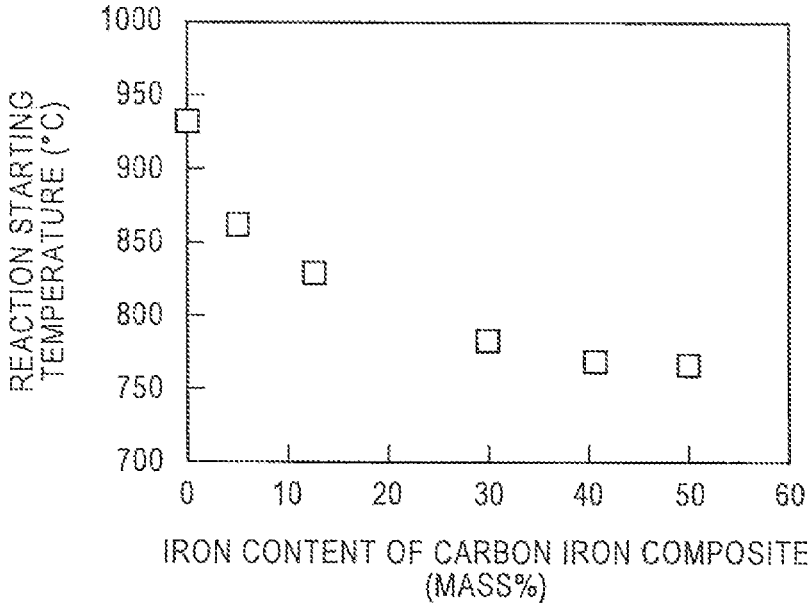
FIG. 8 is a graph illustrating the relationship between the iron content of carbon iron composite and reaction starting temperature.

As for a property of carbon iron composite, a carbon iron composite having a low iron content does not have high reactivity with $CO_2$ gas and a carbon iron composite having a high iron content has low strength and is not suitable as a material to be charged into a blast furnace. FIG. 8 illustrates the relationship between the iron content of carbon iron composite and the reaction starting temperature at which carbon iron composite starts to react with a $CO_2$—CO gas mixture. From FIG. 8, as the iron content of carbon iron composite increases, the reactivity increases and the effect of decreasing the reaction starting temperature is exhibited. The effect is considerably exhibited with an iron content of 5 mass % or more and the effect is saturated with an iron content of 40 mass % or more. Accordingly, a desired iron content is 5 to 40 mass %. Thus, the iron content of carbon iron composite is preferably 5 to 40 mass %, more preferably 10 to 40 mass %.

By mixing conventional coke with an ore layer, the permeability of the ore layer is improved. By making the particle size of conventional coke mixed with an ore layer be 5 mm or more, permeability is improved. However, when the particle size of conventional coke mixed with an ore layer becomes excessively large, in the case of making the mixing mass of conventional coke constant, the number of conventional coke particles mixed decreases with an increase in the particle size and conventional coke tends to be unevenly distributed in the ore layer. Accordingly, the particle size is preferably 100 mm or less. Thus, the particle size of conventional coke mixed with an ore layer is preferably 5 to 100 mm. To sufficiently improve permeability, conventional coke preferably has a particle size of more than 20 mm and 100 mm or less, more preferably a particle size of more than 36 mm and 100 mm or less.

Examples

A blast-furnace operation test to which our method was applied was performed. Carbon iron composite was produced by briquetting a mixture of coal and ore with a briquetting machine, charging the briquettes into a vertical shaft furnace, and carbonizing the briquettes. The carbon iron composite had the shape of an elliptic cylinder having dimensions of 30 mm×25 mm×18 mm. The iron content of the carbon iron composite was made 30 mass %.

Materials were charged into a blast furnace in the following manner. A coke layer composed of conventional coke only was first formed. An ore layer mixed with coke (carbon iron composite and/or conventional coke) was charged in two separate batches. The ore layer was charged in three different manners (Test Nos. 1 to 3).

Test No. 1 is our operation method and performed such that carbon iron composite and conventional coke were mixed in the same ore batch in each of the two batches for the ore layer. The state of charged materials stacked in this case is illustrated in FIG. 1.

Test No. 2 is an operation method for comparison in which a mixture of conventional coke and ore was charged in the first batch and a mixture of carbon iron composite and ore was charged in the second batch. Although conventional coke and carbon iron composite appeared to be mixed as a whole of the ore layer, conventional coke and carbon iron composite were mixed in separate ore batches. The state of charged materials stacked in this case is illustrated in FIG. 2.

Test No. 3 is also an operation method for comparison and is an operation serving as a base without using carbon iron composite. The ore layer was formed by charging a mixture of conventional coke and ore in both of the two batches. The state of charged materials stacked in this case is illustrated in FIG. 3.

Figure 2:
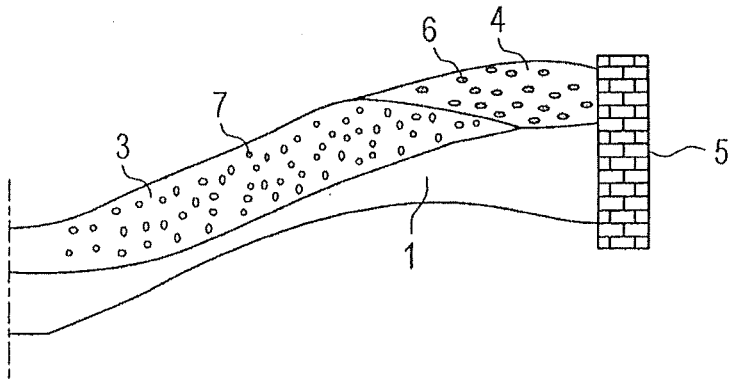
FIG. 2 is a schematic view of a longitudinal section of a blast furnace (Comparative Example).
Figure 3:
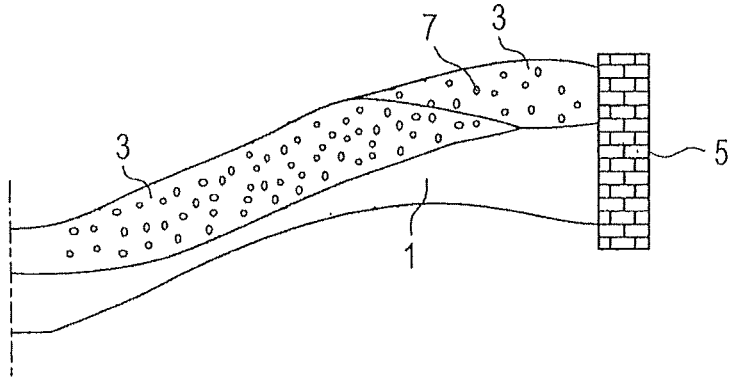
PRIOR ART FIG. 3
FIG. 3 is a schematic view of a longitudinal section of a blast furnace (Comparative Example).

FIGS. 1 to 3 are schematic views of longitudinal sections of blast furnaces. In each figure, the left end of the figure is the center of the furnace and a furnace wall 5 is positioned on the right side.

The test conditions, blast-furnace reducing agent ratios, and direct reducibility of the Tests are compared in Table 1. The particle size of conventional coke mixed with ore was changed in accordance with the following six conditions (A to F):

A: 5 to 20 mm;

B: 5 to 36 mm;

C: more than 20 mm and 36 mm or less;

D: 5 to 100 mm;

E: more than 20 mm and 100 mm or less; and

F: more than 36 mm and 100 mm or less.

The layer composed of conventional coke only was constituted of coke having a particle size of 36 to 100 mm. Under each of the conditions A, B, and C, only coke having a smaller particle size than the coke forming the layer composed of conventional coke only was mixed. Under each of the conditions D and E, the coke forming the layer composed of conventional coke only and the coke having a smaller particle size than this coke were used. Under the condition F, coke that is equivalent to the coke forming the layer composed of conventional coke only was mixed.

TABLE 1

| | | Condition | | | | | |
|---|---|---|---|---|---|---|---|
| | Particle size of mixed conventional coke (mm) | A 5-20 | B 5-36 | C 20-36 | D 5-100 | E 20-100 | F 36-100 |
| Test No. 1 Invention example Carbon iron composite and conventional coke mixed in the same ore batches | Pig iron (T/day) | 11900 | 11900 | 11900 | 11900 | 11900 | 11900 |
| | Unmixed conventional coke ratio (kg/T-p) | 223 | 223 | 223.5 | 223.5 | 224 | 224.5 |
| | Mixed conventional coke ratio (kg/T-p) | 33 | 33 | 33 | 33 | 33 | 33 |
| | Carbon iron composite ratio (kg/T-p) | 101 | 101 | 101 | 101 | 101 | 101 |
| | Pulverized coal ratio (kg/T-p) | 130 | 130 | 130 | 130 | 130 | 130 |
| | Direct reducibility (%) | 22 | 22 | 22.1 | 22.1 | 22.2 | 22.25 |
| | Variation in permeability ($Pa/Nm^3 \cdot min$) | 0.40 | 0.395 | 0.39 | 0.388 | 0.375 | 0.37 |
| Test No. 2 Comparative example Carbon iron composite and conventional coke mixed in separate ore batches | Pig iron (T/day) | 11900 | 11900 | 11900 | 11900 | 11900 | 11900 |
| | Unmixed conventional coke ratio (kg/T-p) | 243 | 243 | 243.5 | 243.5 | 244 | 244.5 |
| | Mixed conventional coke ratio (kg/T-p) | 33 | 33 | 33 | 33 | 33 | 33 |
| | Carbon iron composite ratio (kg/T-p) | 101 | 101 | 101 | 101 | 101 | 101 |
| | Pulverized coal ratio (kg/T-p) | 130 | 130 | 130 | 130 | 130 | 130 |
| | Direct reducibility (%) | 23.4 | 23.4 | 23.45 | 23.45 | 23.5 | 23.55 |
| | Variation in permeability ($Pa/Nm^3 \cdot min$) | 0.42 | 0.415 | 0.41 | 0.408 | 0.395 | 0.39 |
| Test No. 3 Comparative example Without using carbon iron composite | Pig iron (T/day) | 11900 | 11900 | 11900 | 11900 | 11900 | 11900 |
| | Unmixed conventional coke ratio (kg/T-p) | 315 | 315 | 315.5 | 315.5 | 316 | 316.5 |
| | Mixed conventional coke ratio (kg/T-p) | 47 | 47 | 47 | 47 | 47 | 47 |
| | Carbon iron composite ratio (kg/T-p) | 0 | 0 | 0 | 0 | 0 | 0 |
| | Pulverized coal ratio (kg/T-p) | 130 | 130 | 130 | 130 | 130 | 130 |
| | Direct reducibility (%) | 25.4 | 25.4 | 25.5 | 25.5 | 25.7 | 25.75 |
| | Variation in permeability ($Pa/Nm^3 \cdot min$) | 0.44 | 0.435 | 0.43 | 0.428 | 0.415 | 0.41 |

In Table 1, the "Unmixed conventional coke" denotes conventional coke not mixed with ore and charged into a blast furnace (coke of coke layer). The "Mixed conventional coke" denotes conventional coke mixed with ore. In both of Test Nos. 1 and 2, the conventional coke ratio decreased, compared with Test No. 3 in which carbon iron composite was not used. The decrease in the conventional coke ratio was larger in Test No. 1 in which carbon iron composite and mixed conventional coke were mixed in the same ore batches than that in Test No. 2. This is because, as shown in the direct reducibility (the percentage of the reaction represented by the formula (c) above with respect to the total reduction amount, the percentage being calculated from the material balance of a blast furnace) in Table 1, the direct reducibility of Test No. 1 is lower than that of Test No. 2, that is, reduction of ore with the gas was promoted in Test No. 1.

In Test No. 1, which is our Example, the unit consumption of ore was 1562 kg/t-p; the unit consumption of mixed conventional coke was 33 kg/t-p; the mixing amount of conventional coke with respect to ore was 2.1 mass %; the unit consumption of carbon iron composite was 101 kg/t-p; the mixing amount of carbon iron composite with respect to ore was 6.5 mass %; and the total amount of conventional coke and carbon iron composite mixed with ore was 8.6 mass %. Herein, kg/t-p denotes kg per ton of pig iron.

Although the particle size of conventional coke mixed with the ore layers was changed in accordance with the six levels (conditions A to E), direct reducibility did not considerably vary among the conditions. This is probably because the effect of improving permeability of the cohesive zone is exhibited regardless of the particle size of conventional coke mixed with an ore layer. On the other hand, as for the conditions, the larger the particle size of conventional coke mixed in an ore layer, the smaller the variation in permeability became. This is probably because, as for the conditions, the larger the particle size of conventional coke mixed in the ore layer, the larger the particle size of coke in the dripping zone and the hearth, which are lower than the cohesive zone where the ore layer disappears; and gas flow and the flow of molten iron and slag in the lower portion of the furnace were stabilized.

What is claimed is:

1. A method of operating a blast furnace comprising forming a coke layer formed of conventional coke and an ore layer formed of carbon iron composite, conventional coke and ore in a blast furnace, Wherein the conventional coke in the ore layer has a mixing percentage of 0.5 to 6 mass % with respect to the ore, and the carbon iron composite in the ore layer having a mixing percentage of 1 to 20 mass % with respect to the ore.

2. The method according to claim 1, wherein the mixing percentage of the conventional coke in the ore layer with respect to the ore is 2 to 5 mass %.

3. The method according to claim 1, wherein a total of the conventional coke and the carbon iron composite in the ore layer has a total mixing percentage of 1.5 to 20 mass % with respect to the ore.

4. The method according to claim 3, wherein the total mixing percentage of the conventional coke and the carbon iron composite in the ore layer with respect to the ore is 1.5 to 15 mass %.

5. The method according to claim 1, wherein the carbon iron composite has an iron content of 5% to 40%.

6. The method according to claim 5, wherein the carbon iron composite has an iron content of 10% to 40%.

7. The method according to claim 1, wherein the conventional coke in the ore layer has a particle size of 5 to 100 mm.

8. The method according to claim 7, wherein the conventional coke in the ore layer has a particle size of more than 20 mm and 100 mm or less.

9. The method according to claim 8, wherein the conventional coke in the ore layer has a particle size of more than 36 mm and 100 mm or less.

10. The method according to claim 1, wherein the ore layer and the coke layer are alternately formed.

11. The method according to claim 1, wherein the ore layer is composed of a mixture of the carbon iron composite, the conventional coke, and the ore.

12. The method according to claim 1, wherein the ore layer is formed by charging a mixture of the carbon iron composite, the conventional coke, and the ore into the blast furnace, the mixture having been prepared in advance.

13. The method according to claim 1, wherein the ore layer is formed by charging the carbon iron composite, the conventional coke, and the ore into the blast furnace while the carbon iron composite, the conventional coke, and the ore are mixed together.

14. The method according to claim 1, wherein the ore layer comprises a first ore layer and a second ore layer that are charged in two batches, and in both of the first and second ore layers, the carbon iron composite, the conventional coke, and the ore are mixed together.

* * * * *